US010040625B2

(12) United States Patent
Jiang

(10) Patent No.: US 10,040,625 B2
(45) Date of Patent: Aug. 7, 2018

(54) FASTENER-FREE BOX WITH FAST ASSEMBLY

(71) Applicant: Yixiang Blow Molding Furniture (Ningbo) Co., Ltd., Yuyao (CN)

(72) Inventor: Yixiang Jiang, Yuyao (CN)

(73) Assignee: YIXIANG BLOW MOLDING FURNITURE (NINGBO) CO., LTD., Yuyao (CN)

( * ) Notice: Subject to any disclaimer, the term of this patent is extended or adjusted under 35 U.S.C. 154(b) by 0 days.

(21) Appl. No.: 15/401,069

(22) Filed: Jan. 8, 2017

(65) Prior Publication Data

US 2017/0334638 A1 Nov. 23, 2017

(30) Foreign Application Priority Data

May 20, 2016 (CN) ..... 2016 1 0338549

(51) Int. Cl.

| | |
|---|---|
| ***B65D 90/08*** | (2006.01) |
| ***B65D 43/16*** | (2006.01) |
| ***B65D 43/22*** | (2006.01) |
| ***B65D 6/24*** | (2006.01) |
| ***B65D 6/00*** | (2006.01) |
| ***B65D 6/38*** | (2006.01) |

(52) U.S. Cl.

CPC ..... *B65D 90/08* (2013.01); *B65D 11/1873* (2013.01); *B65D 11/20* (2013.01); *B65D 11/24* (2013.01); *B65D 43/16* (2013.01); *B65D 43/22* (2013.01)

(58) Field of Classification Search

CPC ..... B65D 90/08; B65D 90/02; B65D 43/164; B65D 43/165; B65D 43/163; B65D 43/16; B65D 43/14; B65D 43/22; B65D 43/12; B65D 11/1866; B65D 11/1893; B65D 11/1873; B65D 7/12; B65D 15/24

USPC .... 220/4.32, 4.31, 4.28, 685, 684, 683, 682, 220/691, 844, 843, 842, 836, 810

See application file for complete search history.

(56) References Cited

U.S. PATENT DOCUMENTS 497,205 A * 5/1893 Pia ..... B65D 7/24 220/492
1,198,524 A * 9/1916 Cunliffe ..... B65D 7/26 119/499

(Continued)

FOREIGN PATENT DOCUMENTS

FR 1220757 A * 5/1960 ..... B65D 11/1893

OTHER PUBLICATIONS

Translation of FR 1220757 (Bouchet), Jan. 4, 1960, p. 2.*

*Primary Examiner* — Robert J Hicks
(74) *Attorney, Agent, or Firm* — Platinum Intellectual Property LLP

(57) ABSTRACT

A fastener-free box with fast assembly comprises a base-board, a front board, a rear board, a left board, a right board, and a cover board. An insert-connection structure that is configured to form an insert connection with a respective adjacent board is integrally formed on each of the board; and, a connection structure configured to couple with each other is integrally and individually formed on each of the cover board and the rear board. The structure of the box is simple. In addition, an interlocking structure can be formed after the box is assembled, enabling a robust box structure. Furthermore, the box is ideal for outdoor use as it is water proof.

16 Claims, 18 Drawing Sheets

(56) References Cited

U.S. PATENT DOCUMENTS

| | | | | | |
|---|---|---|---|---|---|
| 2,158,972 | A | * | 5/1939 | Weindel, Jr. | B65D 7/26<br>220/495.01 |
| 2,839,214 | A | * | 6/1958 | Crane | B65D 11/14<br>220/4.28 |
| 5,012,943 | A | * | 5/1991 | King | B65D 11/1873<br>220/4.32 |
| 5,465,901 | A | * | 11/1995 | Paine, Jr. | B65D 1/38<br>220/4.23 |

* cited by examiner

FASTENER-FREE BOX WITH FAST ASSEMBLY

RELATED APPLICATIONS

This application claims priority to Chinese. patent application 201610338549.0, filed May 20, 2016, and entitled "FASTENER-FREE BOX WITH FAST ASSEMBLY", the disclosure of which is hereby incorporated herein by reference in its entirety for all purposes.

FIELD OF THE INVENTION

The present disclosure relates to a box or a storage structure. More particularly, it relates to a fastener-free box with fast assembly.

BACKGROUND

Nowadays, many families place a storage box, e.g. deck box, in the outdoor courtyard for storage of gardening tools or other items so that the courtyard is tidy and appealing. Due to the relative large dimensions, such boxes are usually purchased in an unassembled manner, which need to be assembled at the customer's home. For now, to install a storage box, the customer often uses screw drivers and fasteners such as screws to securely connect the multiple boards. Not only is this process very time-consuming and laborious, it is also low in assembly efficiency. Consequently, the screws need to be loosened one by one to disassemble the box, which is highly inconvenient. Moreover, for boxes fastened by screwed connections, mounting holes must be reserved in advance on the baseboard, side boards, and cover board during their manufacture. For precise assembling, errors in the positions of such reserved mounting holes are not allowed. Otherwise, it may not be assembled in place, or it may be impossible to assemble at all. Also, for some boxes, there are pre-embedded fasteners in the reserved mounting holes. Therefore, additional follow-up manufacturing processes are required after forming the boards to install the pre-embedded fasteners. Such installations are usually completed by workers manually with low-efficiency. In conclusion, the prior box structure needs improvements for the benefits of consumer's experience as well as industrial manufactures.

SUMMARY OF THE INVENTION

One technical solution of the present disclosure is to provide a fastener-free and robust box that is capable of fast assembly and is convenient to assemble.

A technical solution to solve the above problem is a fastener-free box with fast assembly, comprising: a baseboard (1), a front board (2), a rear board (3), a left board (4), a right board (5), and a cover board (6), wherein an insert-connection structure configured to form an insert connection with a respective adjacent board is integrally formed on each of the baseboard (1), the front board (2), the rear board (3), the left board (4), and the right board (5); wherein any three perpendicular boards of the baseboard (1), the front board (2), the rear board (3), the left board (4), and the right board (5) are configured to form an interlocking structure among them; and wherein a connection structure configured to couple with each other is integrally and individually formed on each of the cover board (6) and the rear board (3).

According to some embodiments, a first insert-connection structure may be formed between the left board and the baseboard, limiting the left board to only slide frontward and backward relative to the baseboard; a first insert-connection structure may be formed between the right board and the baseboard, limiting the right board to only slide frontward and backward relative to the baseboard; a second insert-connection structure may be formed between the front board and the left board and between the rear board and the left board, preventing the left board from moving frontward and backward; a second insert-connection structure may be formed between the front board and the right board and between the rear board and the right board, preventing the right board from moving frontward and backward; a third insert-connection structure may be formed between the rear board and the baseboard, preventing the rear board from moving relative to the baseboard; and, a third insert-connection structure may be formed between the front board and the baseboard, preventing the front board from moving relative to the baseboard. In this way, with the first, second, and third insert-connection structures, any three perpendicular boards of the baseboard, the front board, the rear board, the left board, and the right board can form an interlocking structure among them, avoiding relative displacement when the assembly is completed.

Many suitable structures may be applied as the first and second insert-connection structures. According to some embodiments, a horizontal retaining groove of a front-rear direction with an inward opening may be provided at the bottom of each of the left board and the right board, the horizontal retaining groove being a dovetail groove or a T-shape groove; a horizontal rib of a front-rear direction capable of forming an insert connection with the horizontal retaining groove may be provided at each of the left and right sides of the baseboard; the corresponding horizontal retaining groove and horizontal rib form the first insert-connection structure; a vertical retaining groove of an up-down direction with an inward opening may be provided on the front side and the rear side of each of the left board and the right board, the vertical retaining groove being a dovetail groove or a T-shape groove; a vertical rib of a up-down direction capable of forming an insert connection with the vertical retaining groove may be provided on the left side and the right side of each of the front board and the rear board; and, the corresponding vertical retaining groove and vertical rib form the second insert-connection structure. Naturally, the horizontal and vertical retaining grooves may be implemented in any other form of retaining grooves.

According to some embodiments, the horizontal retaining groove may be closed at the front end or the rear end; the vertical retaining groove may be closed at the lower end; a lower step may be formed at both front and rear sides at the top portion of each of the left board and the right board; an upper end of the vertical retaining groove opens at the corresponding lower step; a lug protruding from the vertical rib may be formed at both front and rear sides at the top portion of each of the front board and the rear board, the lug being pushed against the lower step when the corresponding vertical rib and vertical retaining groove are mated by insertion. As one end of the horizontal retaining groove is closed, it is possible for the left and right boards to properly mate with the baseboard by insertion. As the lower end of the vertical retaining groove is closed, it is possible for the front and rear boards to properly mate with the left and right boards by insertion, respectively. Furthermore, upward displacement of the left and right boards relative to the baseboard can be prevented when the lugs are pushed against the lower step.

According to some embodiments, an insert slot may be formed at both front and rear sides of the baseboard; a pin may be integrally formed at the bottom of each of the front board and the rear board, the pin being mated with the corresponding insert slot by insertion to from the third insert-connection structure; the pin may extend downward from the bottom of each of the front board and the rear board and a buckling portion bending inward may be formed at the bottom of the pin; and, the buckling portion may be buckled reversely on an internal edge of the insert slot when the pin is inserted into the corresponding insert slot. In this way, when the front and rear boards are installed onto the baseboard, there may be no gap remaining at the insert slot viewing from inside the box.

To further strengthen the insert-connection structure between the rear board and the baseboard, at least two insert slots may be formed at each of the front and rear sides of the baseboard, the insert slots being strip-shaped slots; at least two strip-shaped grooves may be provided at each of the front and rear sides of the baseboard, the strip-shaped grooves being provided in a left-right direction in an alternate manner with the insert slots of the corresponding side; a bar-shaped rib may be formed at the bottom of each of the front board and the rear board and provided in an alternate manner with the pin; and, the bar-shaped rib may be inserted into the corresponding strip-shaped groove when the pin is inserted into the corresponding insert slot.

To prevent the rain from entering the box from outside, a water baffle edge may be formed at the top portion of each of the front board, the rear board, the left board, and the right board; and, a water baffle groove for receiving the water baffle edge may be formed surrounding a bottom surface of the cover board.

To prevent deformation of the left board and the right board when being pushed inward, preferably, the internal wall of the water baffle groove formed at each of the left and right sides on the bottom surface of the cover board may constitute a solid reinforcing rib that abuts on the internal wall of the corresponding water baffle edge.

To allow the cover board to form a better limiting structure with the left and right boards, preferably, at least two lugs may be formed at the top portion of each of the left board and the right board, and a groove for receiving the lug may be provided in a corresponding location at each of the left and right sides at the bottom of the cover board.

Many types of rotatable structure are possible between the rear board and the cover board. According to some embodiments, the connection structure between the rear board and the cover board may be a rotatable hinge structure, comprising a hinge shaft and a hinge arm that is rotatably attached to the hinge shaft; the hinge shaft may be formed on one of the rear board and the cover board, and correspondingly the hinge arm may be formed on the other one of the rear board and the cover board; and a mating structure that only allows the hinge arm to fit into or detach from the hinge shaft in a certain direction may be formed between the hinge shaft and the hinge arm.

According to some embodiments, the hinge shafts and the hinge mounts may be alternately provided at the top portion of the rear board; the hinge shaft may be a circular shaft with at least one lower cut face and at least one upper cut face formed along the axial direction of the hinge shaft, the lower cut face and the upper cut face being alternately and parallelly provided; correspondingly, the hinge arm may comprise an upper arc-shaped embracing arm and a lower arc-shaped embracing arm that are axially staggered in an up-down direction; and, the vertical distance between the opposite edges of the upper arc-shaped embracing arm and the lower arc-shaped embracing arm may be larger than the vertical distance between the lower cut faces and the upper cut face but smaller than the diameter of the hinge shaft.

According to some embodiments, the cover board may be an arch-shaped structure that rises in the middle with both front and rear sides lowered. By use of an arch-shaped structure for the cover board, the structural and bearing strength of the cover board may be improved so that deformation is not easily caused by irradiation or rain, while the rain fallen onto the cover board can be readily guided away from the cover board.

To reduce the package volume of the box, a first baffle bar in a left-right direction may be formed at each of the front and rear sides of the internal bottom surface of the baseboard and a second baffle bar in a front-rear direction may be formed at each of the left and right sides of the internal bottom surface of the baseboard; an upper end face of the second baffle bar may have an arc shape that is concaved inward from both ends to the middle; a middle portion of the second baffle bar and the internal bottom surface of the baseboard adjacent to this middle portion may together define an inward concave regain; and, an arc of the arc structure of the second baffle bar and an inward concavity of the concave region may match with the arch shape of the cover board. In this way, the inward concave structure on the baseboard can match with the arch shape of the cover board so that the package volume is advantageously reduced.

According to some embodiments, a water baffle rib may be formed inside the region defined by the first baffle bar and the second baffle bar, and a water guide groove may be provided at a joint of the first baffle bar and the second baffle bar. By use of the water guide groove, it is possible to avoid water accumulation in the box. By use of the water baffle rib, it is possible to baffle water from items in the box even at the presence of some water inside the box.

To further reduce the package volume, a fixing pin may be formed at the bottom of each of the left board and the right board, protruding therefrom horizontally; a limiting groove may be formed on the internal bottom surface of the cover board; and, when the left board and the right board are stacked with the top surface facing down onto the internal bottom surface of the cover board, the fixing pin is restrained in the limiting groove.

According to some embodiments a reinforcing bar in a left-right direction may be fixed onto the front bottom of the cover board; a lock latch extending downward may be formed on the reinforcing bar; a recess portion that is sunken inward may be formed on an external surface of the front board, close to the upper edge thereof; a lock hole matching the lock latch may be provided on the recess portion; and, a guide ramp may be formed on the internal surface of the front board corresponding to the recess portion, the guide ramp being above the lock hole. The use of reinforcing bar can improve the structural strength of the cover board. When the cover board is closed, the lock latch may smoothly insert into the lock hole on the front board.

To allow the respective boards to be restrained together during packing, when the cover board is stacked onto the baseboard, the left board and the right board stacked on the cover board, and the front board and the rear board stacked successively in a down-up direction onto the left board and the right board, the lock latch may face upward and constitute a stopper abutting on a side edge of the front board, and a limiting structure for receiving a rotatable structure portion of the rear board may be formed between another side edge of the front board and a corresponding side edge of the cover board.

As a preferred embodiment of any of the above technical solution, the baseboard, the front board, the rear board, the left board, the right board, and the cover board may be blow molding boards; and, the front board, the rear board, the left board, the right board, and the cover board may have plaited structure formed on their external surfaces.

Compared with the prior art, the present disclosure is advantageous in the following aspects: the overall structure of the box is simplified. An insert-connection structure capable of forming an insert connection with a respective adjacent board is integrally formed on each of the baseboard, and a connection structure capable of coupling with each other is integrally formed on each of the cover board and the rear board. Therefore, a user can perform fast assembly or disassembly without using any fasteners or tools. In addition, any three perpendicular boards of the baseboard, the front board, the rear board, the left board, and the right board are capable of forming an interlocking structure among them, enabling an even more robust box, or a box structure. Furthermore, as the box is water proof, it is ideal for outdoor use.

DETAILED DESCRIPTION OF EMBODIMENTS

The present disclosure will be described in further details below with reference to embodiments as shown in the attached figures.

Figure 1:
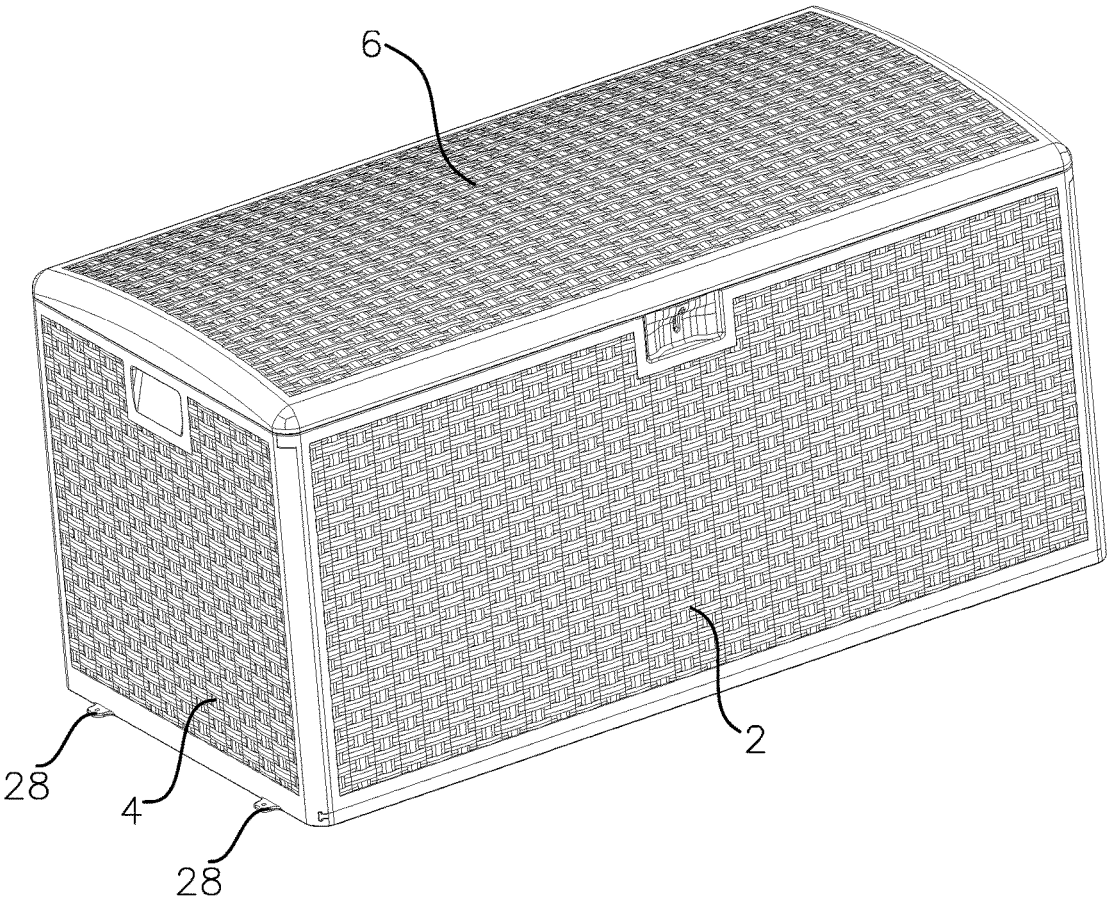
FIG. 1 is a structural schematic of an embodiment according to the present disclosure with the cover board closed.
Figure 2:
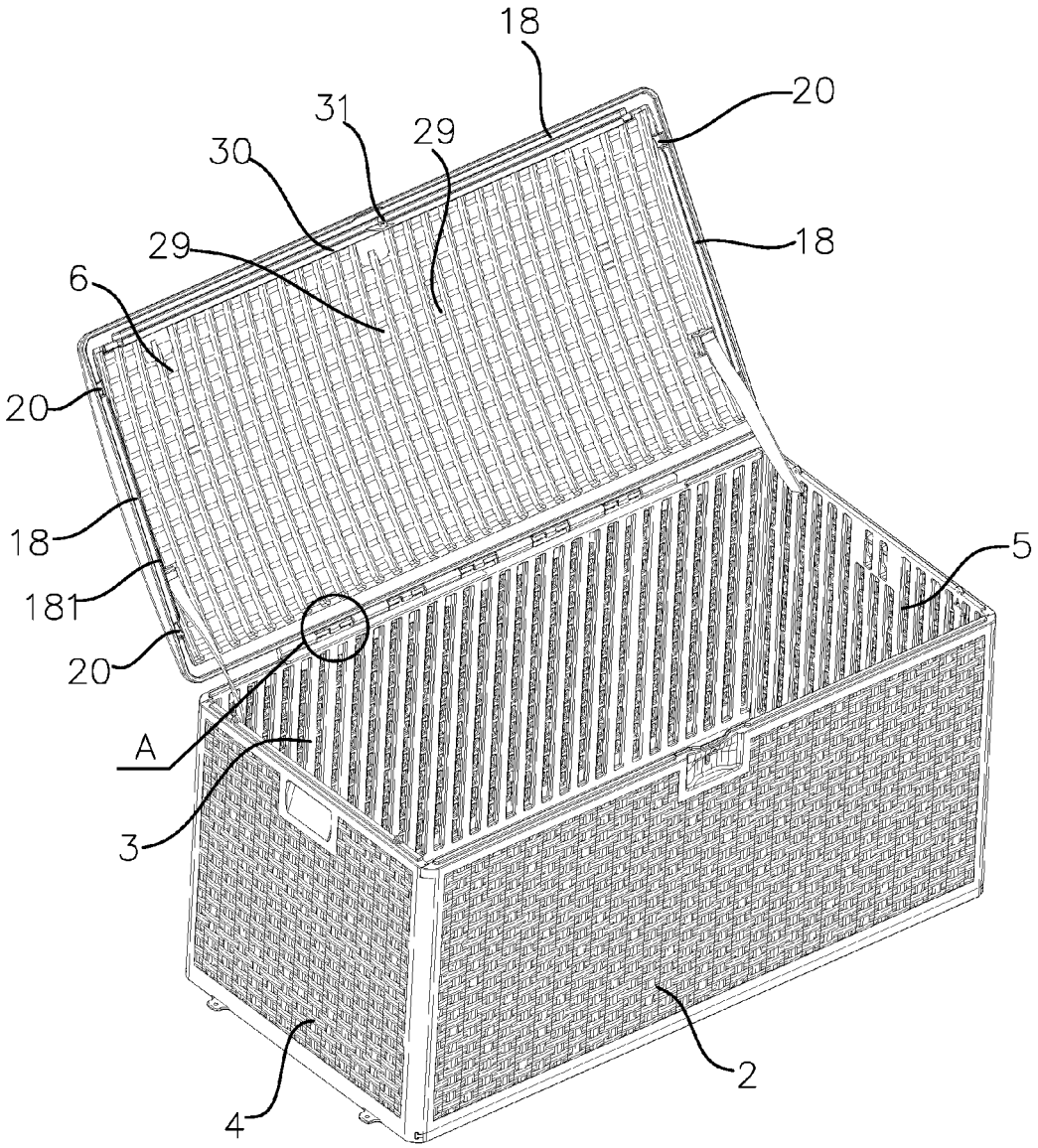
FIG. 2 is a structural schematic of an embodiment according to the present disclosure with the cover board open.
Figure 3:
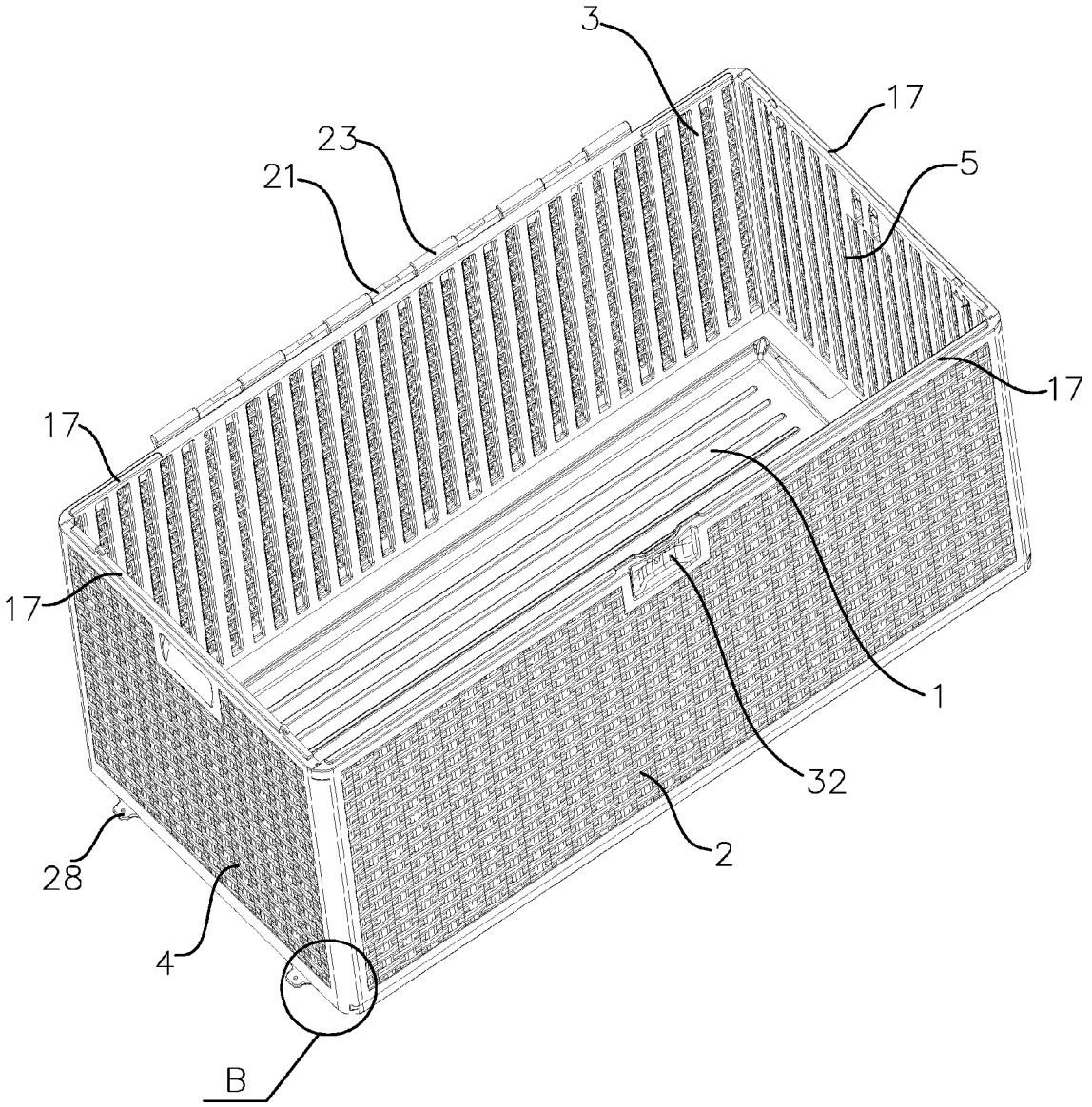
FIG. 3 is a structural schematic of an embodiment according to the present disclosure with the cover board reslided.
Figure 4:
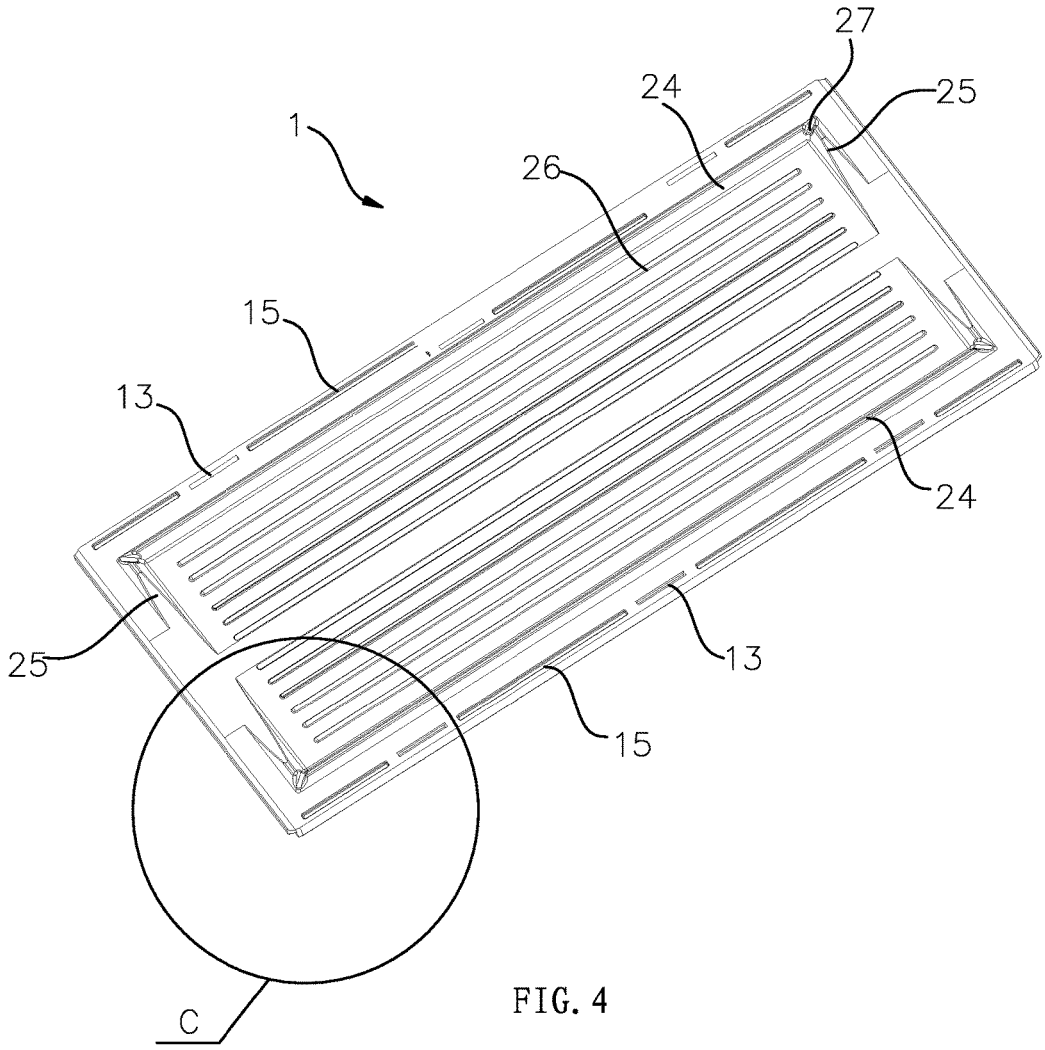
FIG. 4 is a structural schematic of the baseboard in an embodiment according to the present disclosure.
Figure 5:
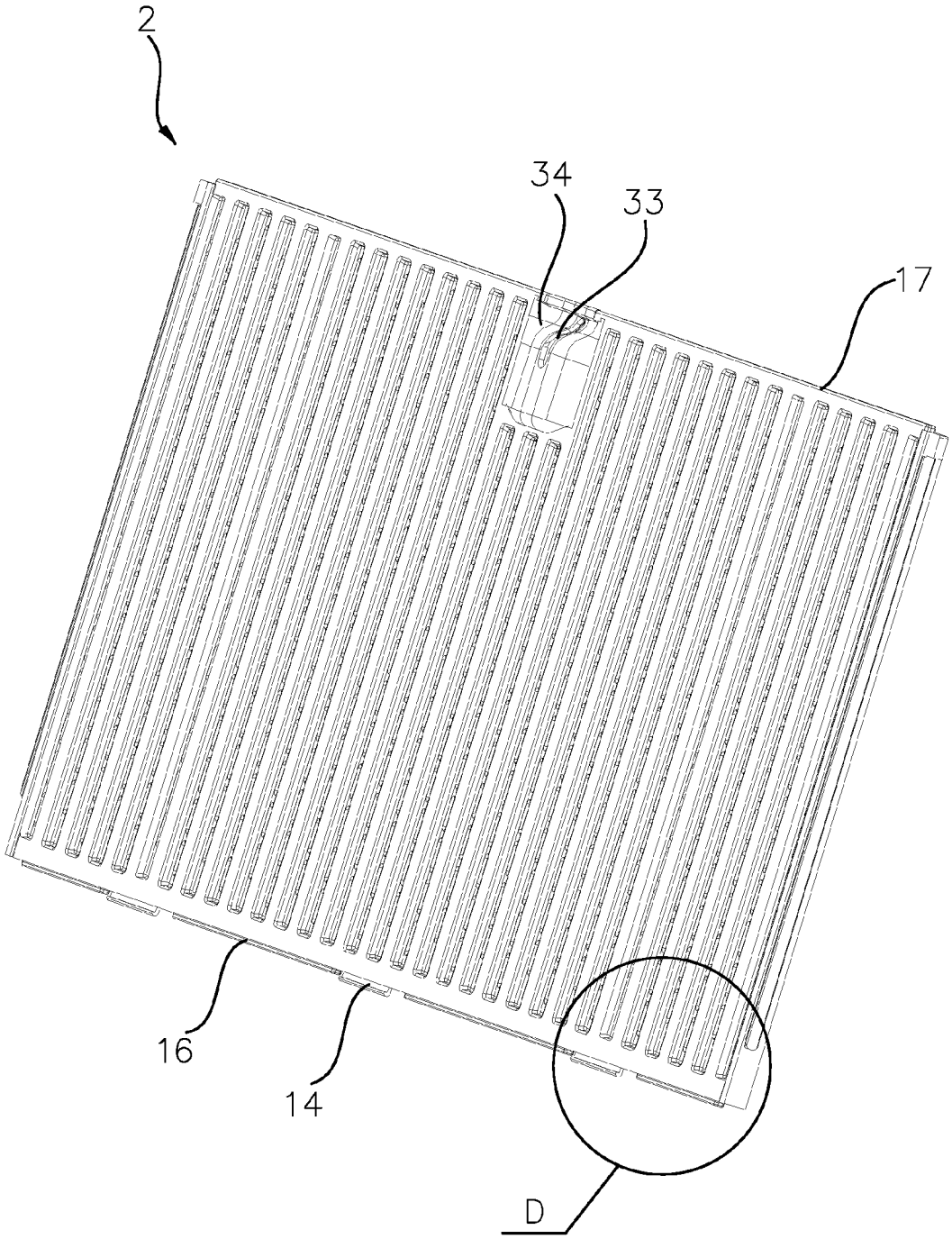
FIG. 5 is a structural schematic of the front board in an embodiment according to the present disclosure.
Figure 6:
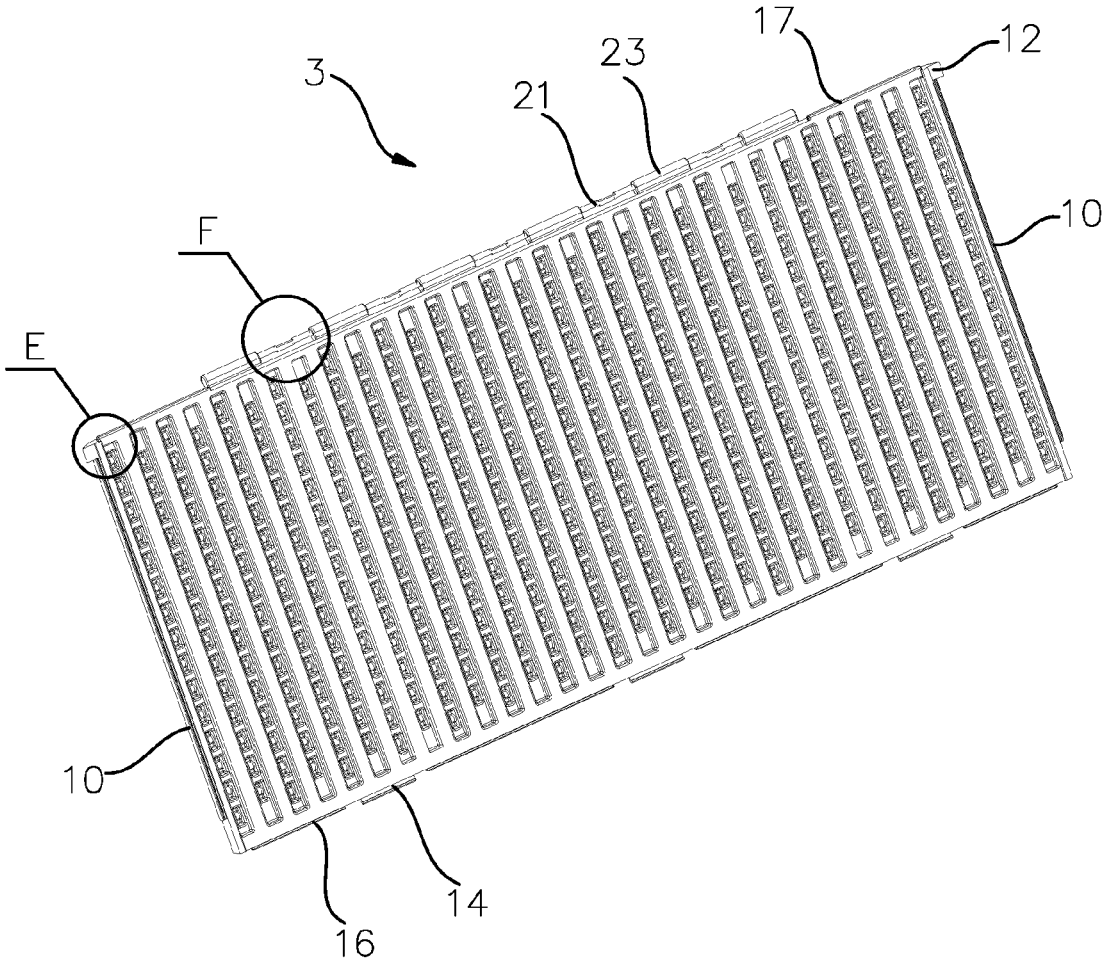
FIG. 6 is a structural schematic of the rear board in an embodiment according to the present disclosure.
Figure 7:
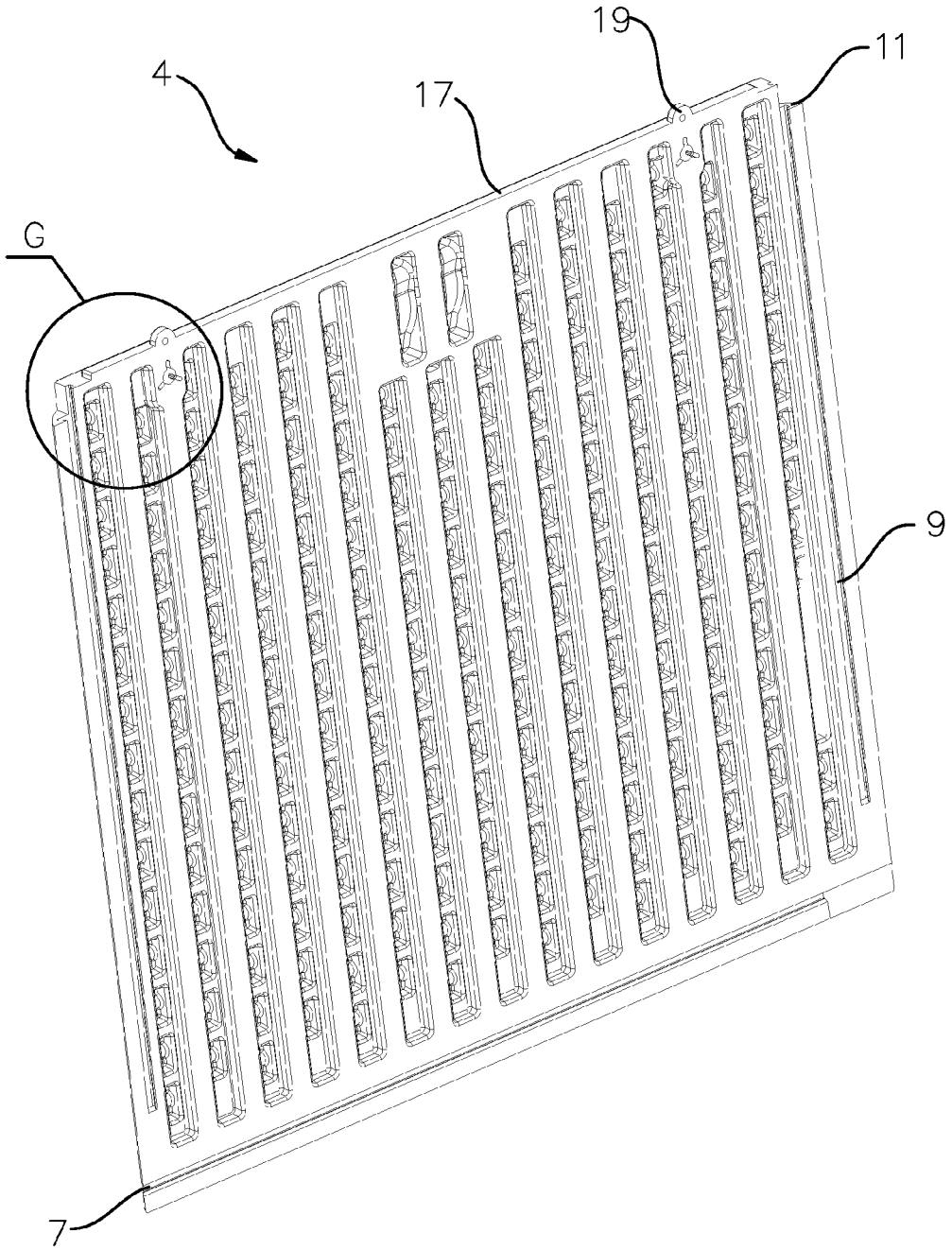
FIG. 7 is a structural schematic of the left board in an embodiment according to the present disclosure.
Figure 8:
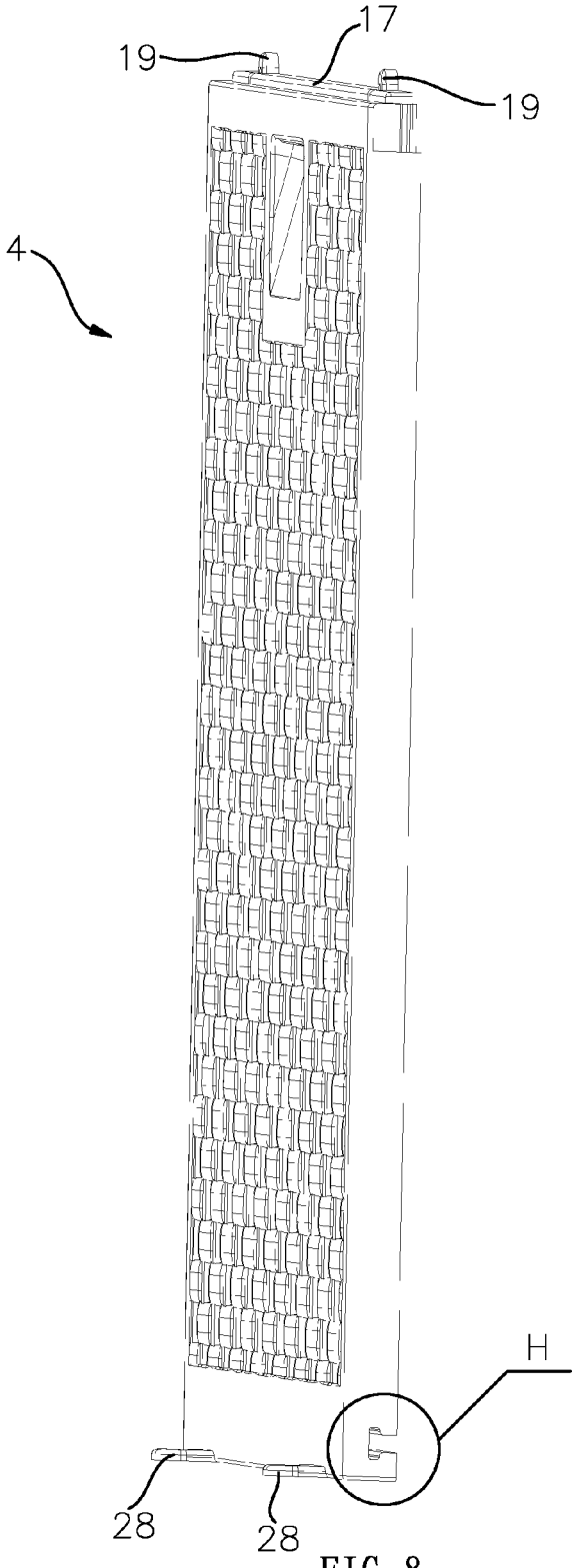
FIG. 8 is a structural schematic from another perspective of the left board in an embodiment according to the present disclosure.
Figure 9:
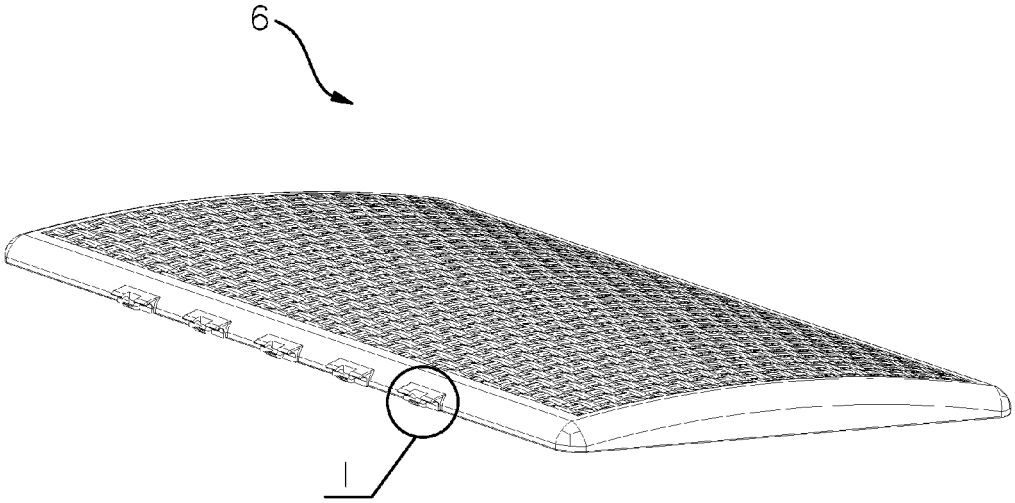
FIG. 9 is a structural schematic of the cover board in an embodiment according to the present disclosure.
Figure 10:
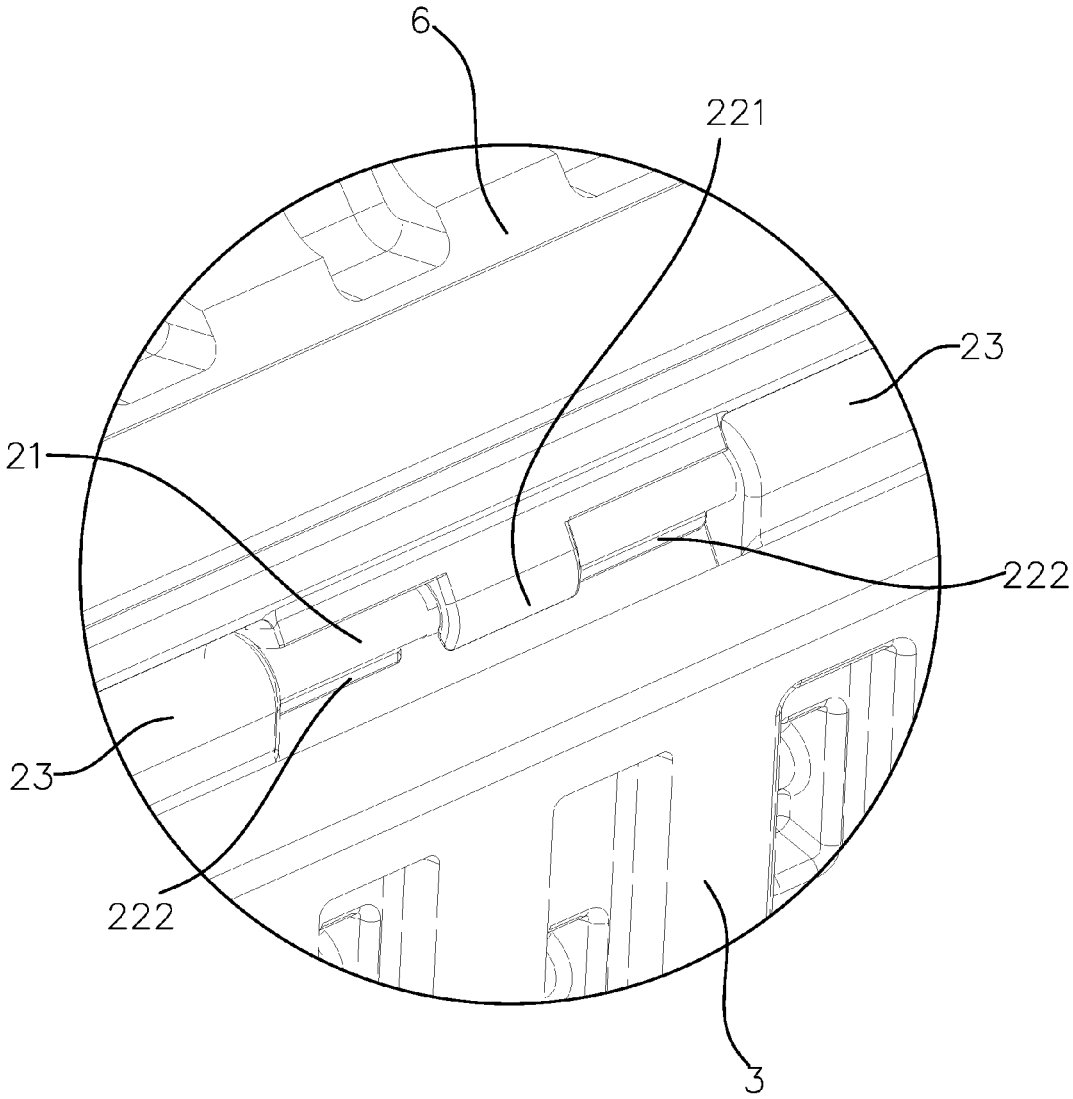
FIG. 10 is an enlarged schematic of the portion A in FIG. 2.
Figure 11:
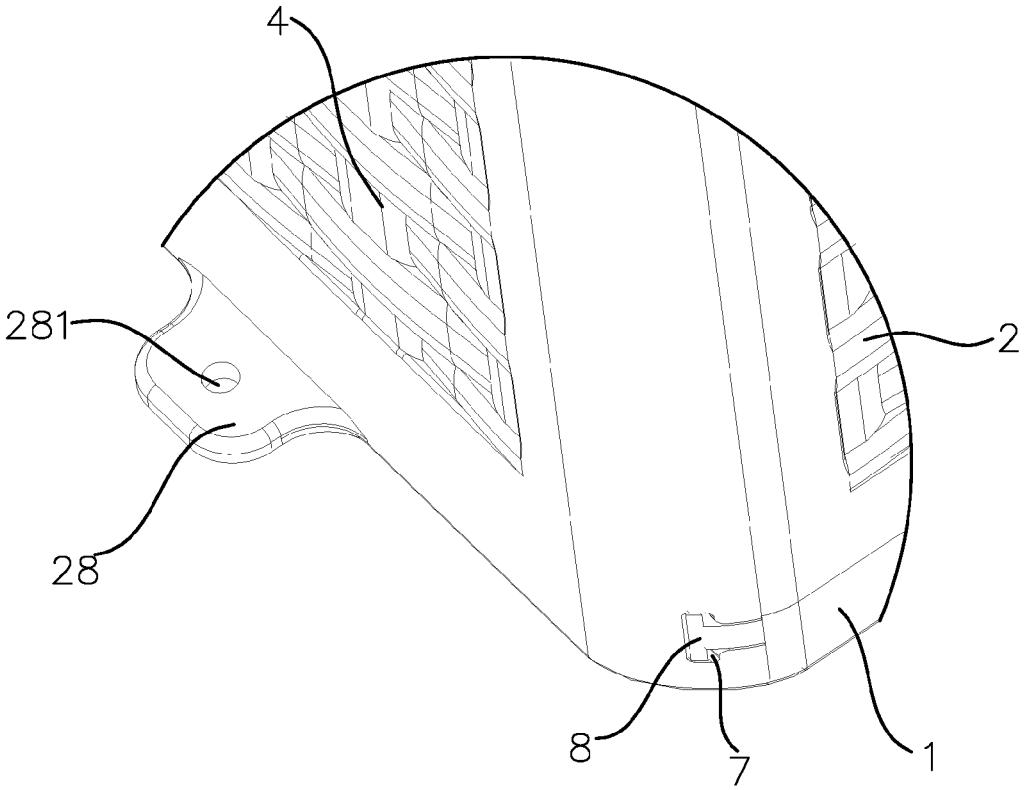
FIG. 11 is an enlarged schematic of the portion B in FIG. 3.
Figure 12:
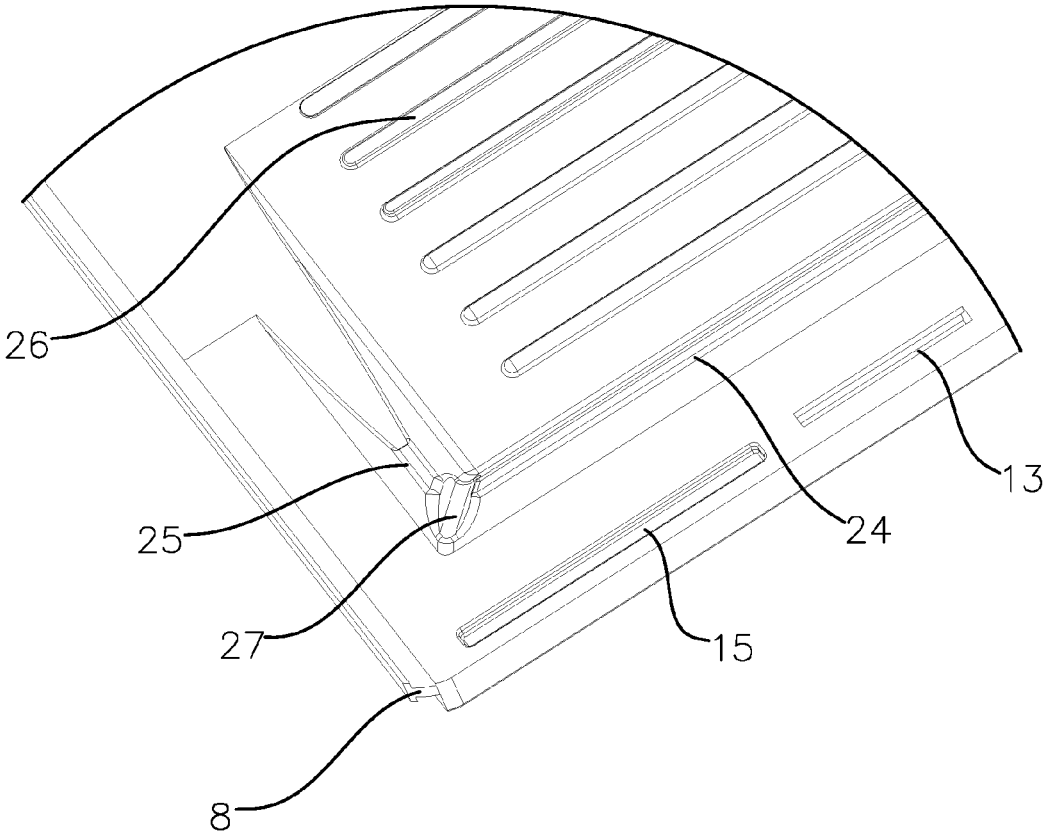
FIG. 12 is an enlarged schematic of the portion C in FIG. 4.
Figure 13:
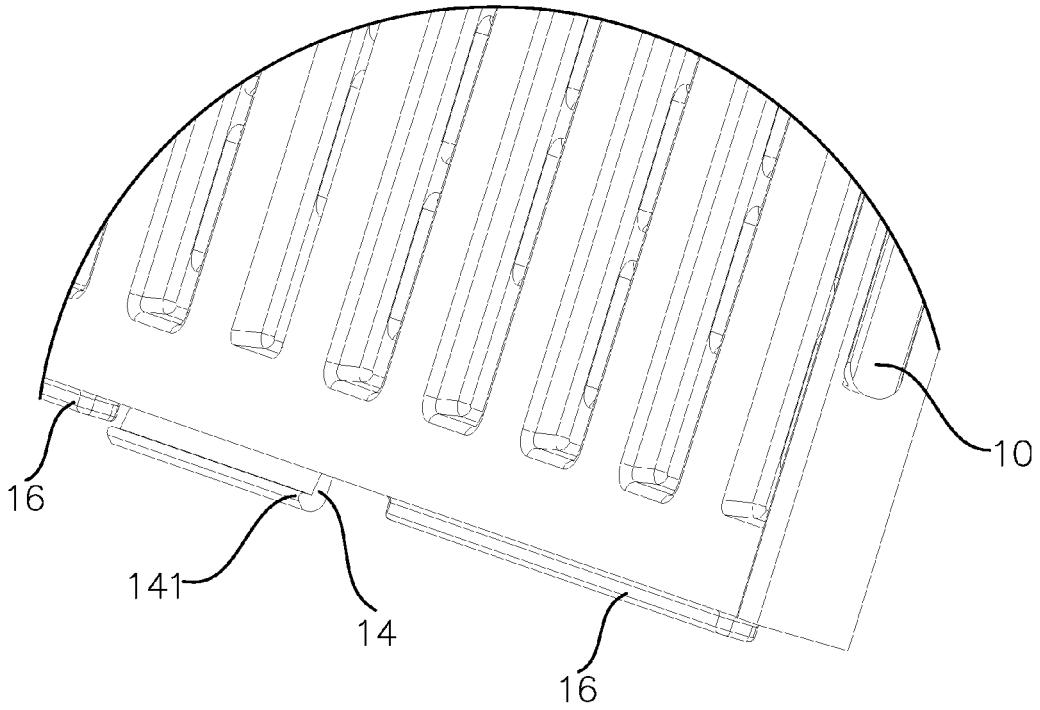
FIG. 13 is an enlarged schematic of the portion D in FIG. 5.
Figure 14:
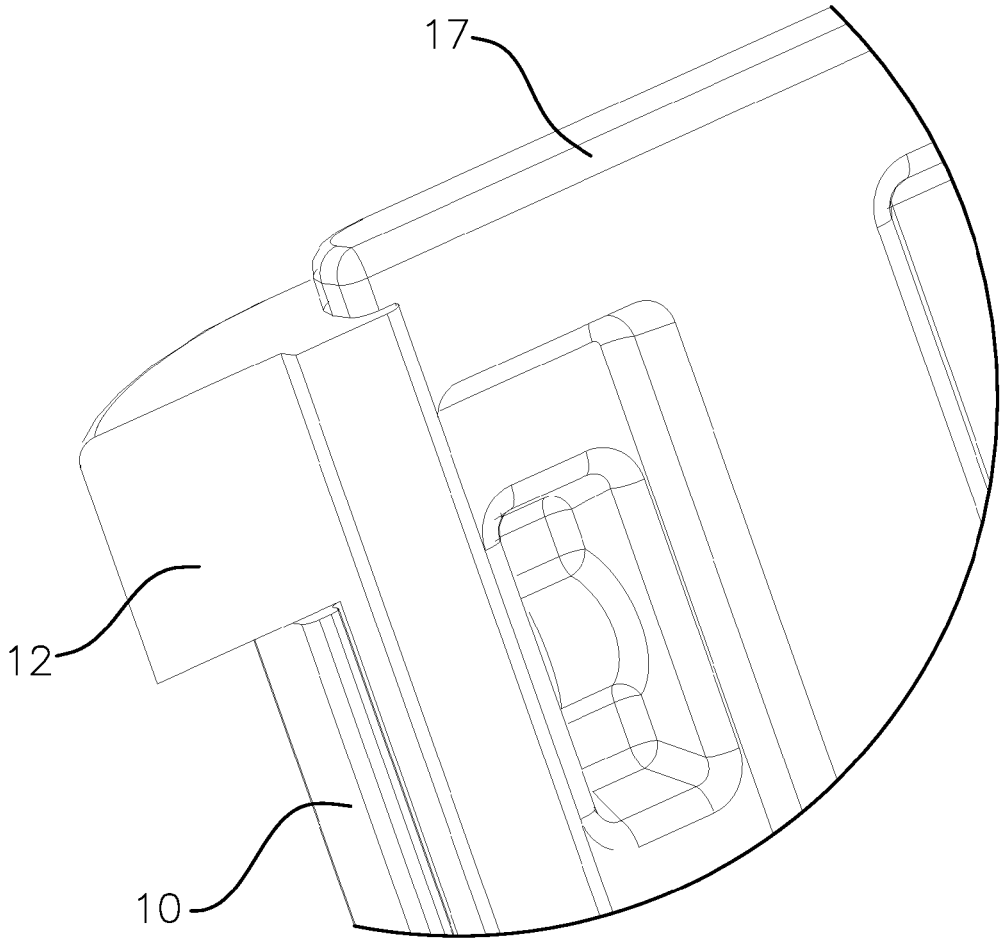
FIG. 14 is an enlarged schematic of the portion E in FIG. 6.
Figure 15:
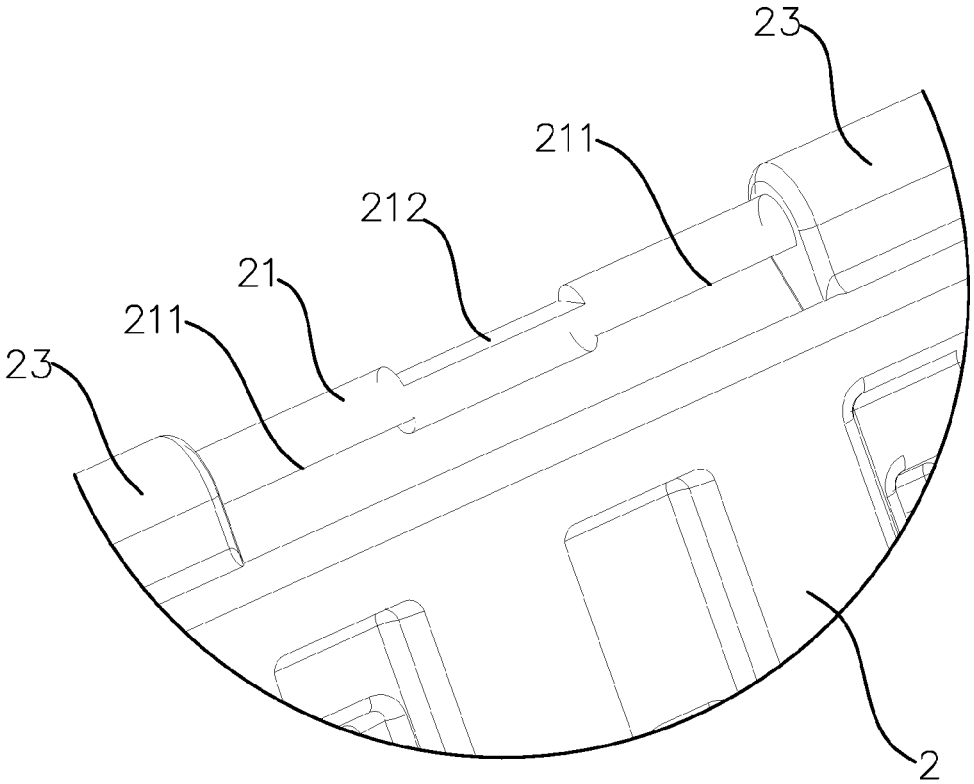
FIG. 15 is an enlarged schematic of the portion F in FIG. 6.
Figure 16:
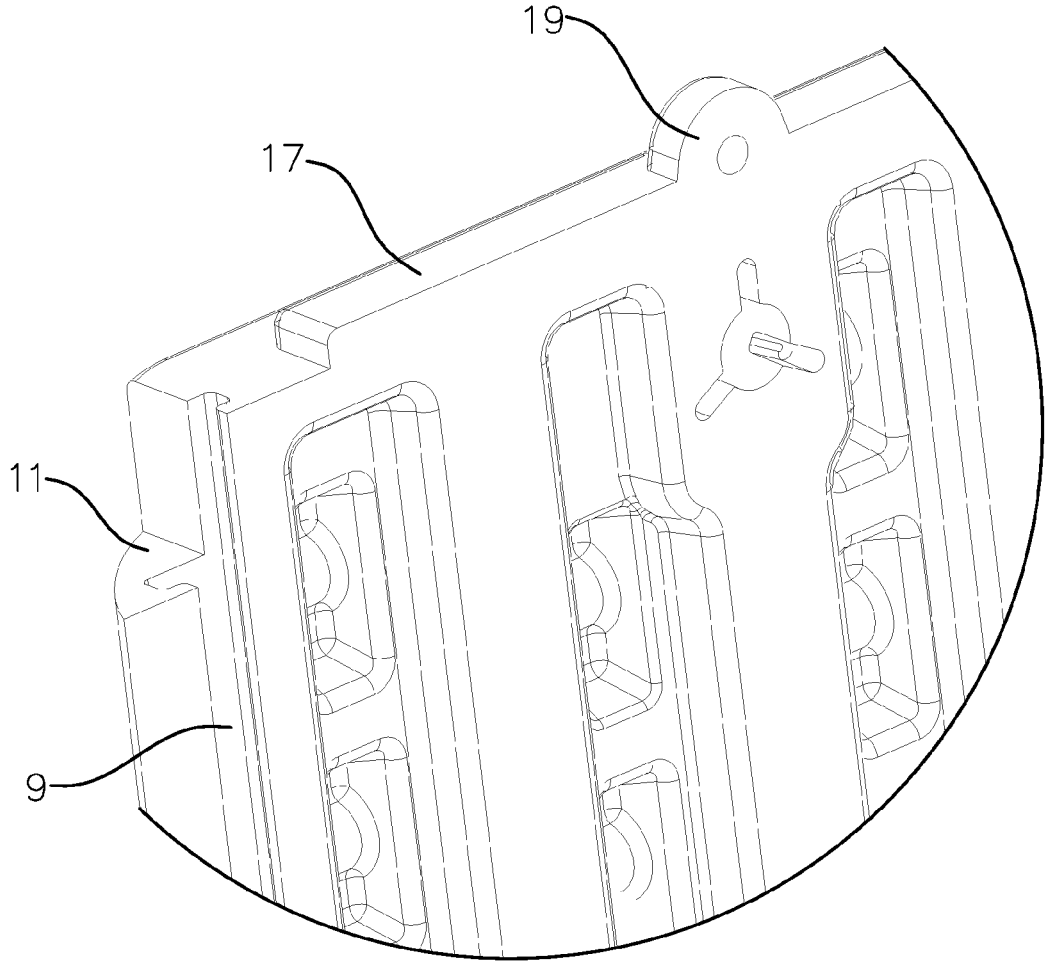
FIG. 16 is an enlarged schematic of the portion G in FIG. 7.
Figure 17:
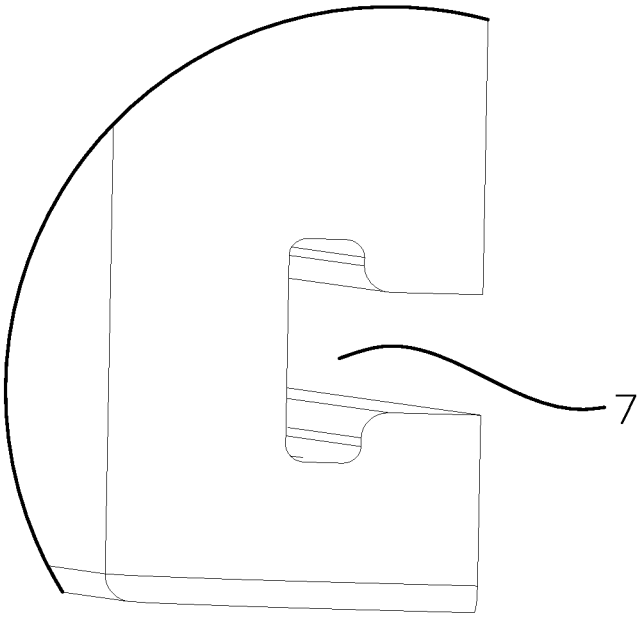
FIG. 17 is an enlarged schematic of the portion H in FIG. 8.
Figure 18:
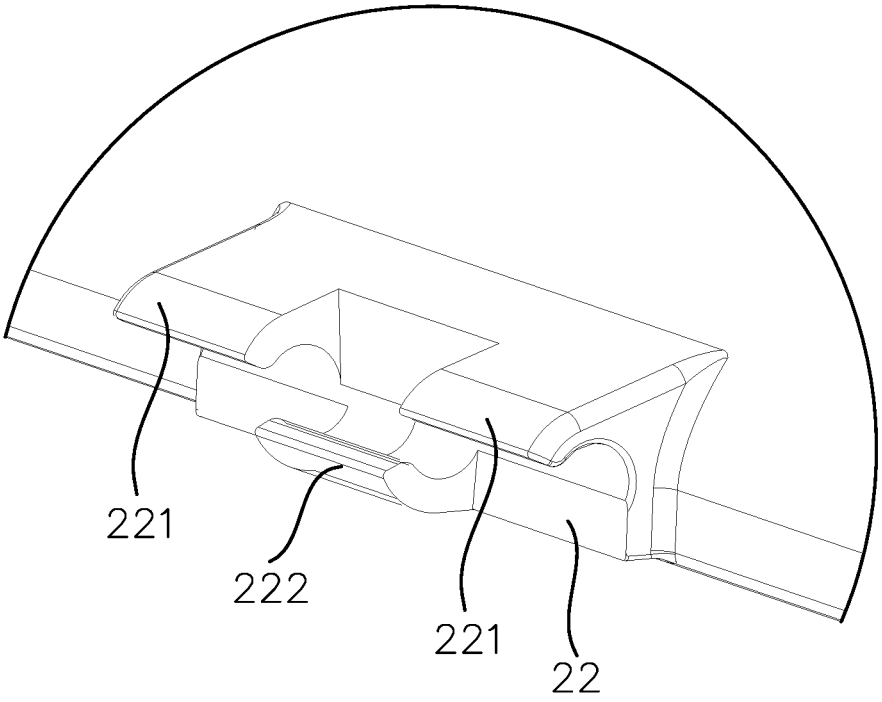
FIG. 18 is an enlarged schematic of the portion I in FIG. 9.

As shown in FIGS. 1 to 3, the box provided in the present embodiment comprises a baseboard 1, a front board 2, a rear board 3, a left board 4, a right board 5, and a cover board 6. An insert-connection structure capable of forming an insert connection with a respective adjacent board is integrally formed on each of the baseboard 1, the front board 2, the rear board 3, the left board 4, and the right board 5. Moreover, any three perpendicular boards of the baseboard 1, the front board 2, the rear board 3, the left board 4, and the right board 5 are capable of forming an interlocking structure among them. That is, after the assembly is completed, the baseboard 1, the front board 2, the rear board 3, the left board 4, and the right board 5 cannot have relative movement. A connection structure capable of coupling with each other is integrally formed on each of the cover board 6 and the rear board 3. Furthermore, the baseboard 1, the front board 2, the rear board 3, the left board 4, the right board 5, and the cover board 6 are blow molding boards. The front board 2, the rear board 3, the left board 4, the right board 5, and the cover board 6 have plaited structure formed on their external surfaces. The bottom of the baseboard 1 has crisscrossed dot structure. In this way, the structural strength of the baseboard can be improved.

In the present embodiment, the left board 4 and the right board 5 have the same structure. Accordingly, the assembling configurations of the left board 4 and the right board 5 are the same. The assembling configuration of the left board will be described below as an example.

As shown in FIGS. 4 to 18, the assembling configuration of the left board 4 and the baseboard 1 is as follows. A horizontal retaining groove 7 of a front-rear direction with an inward opening is formed at the bottom of the left board 4. In the present embodiment, the horizontal retaining groove 7 is a T-shape groove with the rear end closed. A horizontal rib 8 of a front-rear direction capable of forming an insert connection with the horizontal retaining groove 7 is formed on the left side of the baseboard 1. Consequentially, a first insert-connection structure is formed between the left board 4 and the baseboard 1, limiting the left board 4 to only slide frontward and backward relative to the baseboard 1. During installation, the left board 4 is inserted onto the baseboard 1 in a front-rear direction. The left board 4 is installed in place when the closed ends of the horizontal rib 8 and the horizontal retaining groove 7 abut on each other.

The assembling configuration of the left board 4 and the front board 2 is as follows. A vertical retaining groove 9 of an up-down direction with an inward opening is formed at each of the front and rear sides of the left board 4. In the present embodiment, the vertical retaining groove 9 is a T-shape groove with the rear end closed. A vertical rib 10 along an up-down direction capable of forming an insert connection with the vertical retaining groove 9 is formed at each of the front and rear sides of the front board 2. In this way, when the insertion connection between the left board 4 and the front board 2 is completed, a second insert-connection structure is formed between the left board 4 and the front board 2, preventing the left board 4 to slide frontward and backward. Moreover, a lower step 11 is formed at both front and rear sides at the top portion of the left board 4. The upper end of the vertical retaining groove 9 opens to the corresponding lower step 11. A lug 12 protruding from the vertical rib 10 is formed at both front and rear sides at the top portion of the front board 2. During installation, the front board 2 is inserted into the left board 4 in an up-down direction. The front board 2 is installed in place when the lower ends of the vertical rib 10 and the vertical retaining groove 9 abut on each other. Meanwhile, the lug 12 is pushed against the lower step 11 to prevent the left board 4 from moving upward. The installation configurations of the left board 4 and the rear board 3 may be considered by referring to the installation configurations of the left board 4 and the front board 2 and will not be explained in details here.

The assembling configuration of the front board 2 and the baseboard 1 is as follows. An insert slot 13 and strip-shaped groove 15, with each of the quantity being at least two, are provided alternately of a left-right direction at both the front and rear sides of the baseboard 1. Pin 14 and bar-shaped rib 16 are formed alternately in a left-right direction at the bottom of the front board 2. Each pin 14 corresponds to an insert slot 13 and each bar-shaped rib 16 corresponds to a strip-shaped groove 15 in with one-to-one correspondence. During installation, a pin 14 is inserted into the corresponding insert slot 13, while a bar-shaped rib 16 is inserted into the corresponding strip-shaped groove 15. Moreover, a buckling portion 141 bending inward is formed at the bottom of the pin 14. When a pin 14 is inserted into an insert slot 13, the buckling portion 141 is buckled reversely on the internal edge of the insert slot 13, thus preventing the front board 2 from being lift upward. In this way, a third insert-connection structure that can prevent the displacement of the front board 2 relative to the baseboard 1 is formed by the inserted mating between the pin 14 and the insert slot 13. In addition, there is no gap remaining viewable at the insert slot 13 from inside the box. The installation configuration between the rear board 3 and the baseboard 1 is the same as that of the front board 2 and the baseboard 1, and will not be explained in details herein.

The connection structure between the rear board 3 and the cover board 6 is a rotatable hinge structure. Specifically, the hinge structure comprises a hinge shaft 21, a hinge arm 22, and a hinge mount 23. The hinge shaft 21 and the hinge mount 23 are formed integrally at the top portion of the rear board 3, and the hinge arm 22 is formed on the rear lateral portion of the cover board 6. A mating structure that only allows the hinge arm 22 to fit into or detach from the hinge shaft 21 in a certain direction is formed between the hinge shaft 21 and the hinge arm 22.

According to some embodiments, a plurality of hinge shafts 21 and hinge mounts 23 are alternately provided on the rear board 3. The mating structure of the hinge shaft 21 and the hinge arm 22 is as follows. The hinge shaft 21 is a circular shaft with two lower cut faces 211 and an upper cut face 212 formed along the axial direction of the hinge shaft, the lower cut faces 211 and the upper cut face 212 being alternately provided in a horizontal plane. The hinge arm 22 comprises an upper arc-shaped embracing arm 221 and a lower arc-shaped embracing arm 222 that are axially staggered in an up-down direction. The vertical distance between the opposite edges of the upper arc-shaped embracing arm 221 and the lower arc-shaped embracing arm 222 is larger than the vertical distance between the lower cut faces 211 and the upper cut face 212 but smaller than the diameter of the hinge shaft 21. In this way, the cover board 6, when being installed to the rear board 3, can only be installed onto the rear board 3 from a direction perpendicular with the rear board 3, and can be installed onto the rear board 3 by rotating a certain angle after insertion. During disassembly of the cover board 6, the cover board 6 can only be detached after being rotated to a perpendicular position with the rear board 3.

According to some embodiments, a water baffle edge 17 is formed at the top portion of each of front board 2, the rear board 3, the left board 4 and the right board 5. A water baffle groove 18 is formed surrounding the bottom surface of the cover board 6. The water baffle edge 17 fits into the water baffle groove 18 when the cover board 6 is closed so that the box is waterproof. Meanwhile, the water baffle edge 17 and the water baffle groove 18 are configured to limit displacement. In particular, the internal wall of the water baffle groove 18 formed at each of the left and right sides on the bottom surface of the cover board constitutes a solid reinforcing rib 181, which abuts on the internal wall of the corresponding water baffle edge 17. In this way, it is possible to effectively prevent deformation of the left board 4 and the right board 5 in the portion close to their upper edges when being pushed inward. In addition, the cover board 6 of the present embodiment is designed to be an arch-shaped structure that rises in the middle with both front and rear sides lowered. In this way, the structural and bearing strength of the cover board 6 are improved so that deformation is not easily caused by irradiation or rain, while the rain fallen onto the cover board 6 can be readily guided away from the cover board. Furthermore, to prevent displacement of the cover board 6 after closing, two lugs 19 are formed at the top portion of each of the left board 4 and the right board 5, while a groove 20 is provided in a corresponding location at each of the left and right sides at the bottom of the cover board 6. The lug 19 fits into the corresponding groove 20 when the cover board 6 is closed.

According to some embodiments, to match the arched structure of the cover board 6, a first baffle bar 24 in a left-right direction is formed at each of the front and rear sides of the internal bottom surface of the baseboard 1 and a second baffle bar 25 in a front-rear direction is formed at each of the left and right sides of the internal bottom surface of the baseboard 1. The upper end face of the second baffle bar 25 has an arc shape that is concaved inward from both ends to the middle. The middle portion of the second baffle bar 25 and the internal bottom surface of the baseboard 1 that is adjacent to this middle portion together define a inward concave regain. Moreover, the arc of the arc structure of the second baffle bar 25 and the inward concavity of the aforementioned concave region match with the arch shape of the cover board 6. Accordingly, the inward concave structure on the baseboard can match the arch shape of the cover board 6. During packing of the box, the cover board 6 may be stacked onto the internal bottom surface of the baseboard 1 with the top surface facing down so that the package volume is advantageously reduced. According to some embodiments, a water baffle rib 26 is formed inside the region between the first baffle bar 24 and the second baffle bar 25, and a water guide groove 27 is provided at the joint of the first baffle bar 24 and the second baffle bar 25. With the water guide groove 27, it can effectively prevent water accumulation in the box. With the water baffle rib 26, it further protects stored items when there is a small amount of water collected in the box.

To fix the box on the ground, a fixing pin 28 with a mounting hole 281 is formed at the bottom of each of the left board 4 and the right board 5, protruding therefrom horizontally. Moreover, a limiting groove 29 is formed on the internal bottom surface of the cover board 6. During packing, when the left board 4 and the right board 5 are stacked with the top surface facing down onto the internal bottom surface of the cover board 6, the fixing pin 28 can be stored tightly in the limiting groove 29 so that it does not take additional package volume.

According to some embodiments, a reinforcing bar 30 in a left-right direction is fixed onto the front bottom of the cover board 6. The use of reinforcing bar 30 can improve the structural strength of the cover board. A lock latch 31 extending downward is formed in the middle of the reinforcing bar 30. A recess portion 32 that is sunken inward is formed on the external surface of the front board 2, close to the upper edge. A lock hole 33 matching the lock latch 31 is provided on the recess portion 32. Moreover, a guide ramp 34 is formed on the internal surface of the front board corresponding to the recess portion 32. The guide ramp 34 is above the lock hole 33. When the cover board is closed, the lock latch 31 gets in touch with the guide ramp 34 and comes to fit into the lock hole 33.

During packing, the baseboard 1 is first laid flat with the bottom surface facing downward and the cover board 6 is stacked onto the baseboard 1 with the top surface facing downward. Then, the left board 4 and the right board 5 are stacked at each of the left and right sides of the cover board 6, with their external surfaces facing downward. Finally, the front board 2 and the rear board 3, with their external surfaces facing downward, are stacked successively on top of the left board 4 and the right board 5. When packing is completed, the lock latch 31 faces upward and abuts right on the top edge of the front board 2, and a retaining structure for receiving the hinge mount 23 and the hinge shaft 21 of the rear board 3 is formed between the bottom edge of the front board 2 and the rear edge of the cover board 6, so that the protruding hinge mount 23 and hinge shaft 21 may not occupy extra package volume. When packing is completed, it is possible to prevent the respective board from sliding as well as make full use of the space so that the package volume is reduced.

The embodiments described above are only some of the preferred embodiments of the present disclosure. It would be understood by a person skilled in the art that various changes and modifications can be made to the embodiments described herein without departing from the scope and spirit of the present disclosure. Such changes and modifications should be considered as within the protection scope claimed by the present disclosure.

What is claimed is:

1. A fastener-free box with fast assembly, comprising:

a baseboard (1);

a front board (2);

a rear board (3);

a left board (4), a right board (5);

a cover board (6);

a first insert-connection structure between the left board (4) and the baseboard (1) configured to enable the left board (4) to only slide frontward and backward relative to the baseboard (1);

a second insert-connection structure individually formed between the front board (2) and the left board (4) and between the rear board (3) and the left board (4) configured to prevent the left board (4) to slide frontward and backward;

a third insert-connection structure between the rear board (3) and the baseboard (1) configured to prevent the rear board (3) to slide relative to the baseboard (1);

wherein an insert-connection structure configured to form an insert connection with a respective adjacent board is integrally formed on each of the baseboard (1), the front board (2), the rear board (3), the left board (4), and the right board (5);

wherein any three perpendicular boards of the baseboard (1), the front board (2), the rear board (3), the left board (4), and the right board (5) are configured to form an interlocking structure among them;

wherein a connection structure configured to couple with each other is integrally and individually formed on each of the cover board (6) and the rear board (3); and wherein the second insert-connection structure further comprises:

a horizontal retaining groove (7) with an inward opening at a bottom of each of the left board (4) and the right board (5), the horizontal retaining groove (7) being one of a dovetail groove and a T-shape groove; and a horizontal rib (8) configured to form the first insert-connection structure with the horizontal retaining groove (7) at each of the left and right sides of the baseboard (1).

2. The fastener-free box with fast assembly of claim 1, further comprising:

a vertical retaining groove (9) with an inward opening on a front side and a rear side of each of the left board (4) and the right board (5), the vertical retaining groove (9) being one of a dovetail groove and a T-shape groove; and a vertical rib (10) configured to form the second insert-connection structure with the vertical retaining groove (9) on a left side and a right side of each of the front board (2) and the rear board (3), wherein the horizontal retaining groove (7) is closed at a front end or a rear end; the vertical retaining groove (9) is closed at a lower end; a lower step (11) is formed at both front and rear sides at the top portion of each of the left board (4) and the right board (5); an upper end of the vertical retaining groove (9) opens at the corresponding lower step (11); a lug (12) protruding from the vertical rib (10) is formed at both front and rear sides at the top portion of each of the front board (2) and the rear board (3), the lug (12) being pushed against the lower step (11) when the corresponding vertical rib (10) and vertical retaining groove (9) are mated by insertion.

3. The fastener-free box with fast assembly of claim 1, further comprising:

at least two insert slots (13) at each of the front and rear sides of the baseboard (1), the insert slots (13) being strip-shaped slots;

at least two strip-shaped grooves (15) at each of the front and rear sides of the baseboard (1), the strip-shaped grooves (15) being provided in a left-right direction in an alternate manner with the insert slots (13) of the corresponding side; and a bar-shaped rib (16) at the bottom of each of the front board (2) and the rear board (3), the bar-shaped rib (16) being arranged in an alternate manner with a pin (14), the bar-shaped rib (16) being inserted into the corresponding strip-shaped groove (15) when the pin (14) is inserted into the corresponding insert slot (13), wherein an insert slot (13) is formed at both front and rear sides of the baseboard (1); the pin (14) is integrally formed at the bottom of each of the front board (2) and the rear board (3), the pin (14) being mated with the corresponding insert slot (13) by insertion to from the third insert-connection structure; the pin (14) extends downward from the bottom of the front board and the rear board and a buckling portion (141) bending inward is formed at the bottom of the pin (14); and, the buckling portion (141) is buckled reversely on an internal edge of the insert slot (13) when the pin (14) is inserted into the corresponding insert slot (13).

4. The fastener-free box with fast assembly of claim 1, further comprising:

a water baffle edge (17) at the top portion of each of the front board (2), the rear board (3), the left board (4), and the right board (5);

a water baffle groove (18) configured to receive the water baffle edge (17) on a bottom surface of the cover board (6);

a solid reinforcing rib (181) having an internal wall of the water baffle groove (18) at each of the left and right sides on the bottom surface of the cover board, the solid reinforcing rib (181) abutting an internal wall of the corresponding water baffle edge (17).

5. The fastener-free box with fast assembly of claim 1, further comprising:

at least two lugs (19) at the top portion of each of the left board (4) and the right board (5), and at least two grooves (20) configured to receive the at least two lugs (19) in corresponding locations at each of the left and right sides at the bottom of the cover board (6).

6. The fastener-free box with fast assembly of claim 1, further comprising:

a rotatable hinge structure between the rear board (3) and the cover board (6), wherein the rotatable hinge structure includes a hinge shaft (21) on one of the rear board (3) and the cover board (6) that is rotatably attached to a hinge arm (22) correspondingly on the other one of the rear board (3) and the cover board (6); and a mating structure between the hinge shaft (21) and the hinge arm (22), the mating structure allowing the hinge arm (22) to fit into or detach from the hinge shaft (21) in a certain direction, wherein the hinge shafts (21) and hinge mounts (23) are alternately provided at the top portion of the rear board (3); the hinge shaft (21) is a circular shaft with at least one lower cut face (211) and at least one upper cut face (212) formed along the axial direction of the hinge shaft, the lower cut face (211) and the upper cut face (212) being alternately and parallelly provided; correspondingly, the hinge arm (22) comprises an upper arc-shaped embracing arm (221) and a lower arc-shaped embracing arm (222) that are axially staggered in an up-down direction; and, the vertical distance between the opposite edges of the upper arc-shaped embracing arm (221) and the lower arc-shaped embracing arm (222) is larger than the vertical distance between the lower cut faces (211) and the upper cut face (212) but smaller than the diameter of the hinge shaft (21).

7. The fastener-free box with fast assembly of claim 1, wherein the cover board (6) has an arch-shaped structure that rises in the middle with lowered front and rear sides, wherein the baseboard (1) has a first baffle bar (24) on an internal bottom surface and a second baffle bar (25) on each of the left and right sides of the internal bottom surface; and wherein an upper end face of the second baffle bar (25) is an arc shape that is concaved inward from both ends to the middle; a middle portion of the second baffle bar (25) and the internal bottom surface of the baseboard (1) adjacent to this middle portion together define an inward concave regain; and, an arc of the arc structure of the second baffle bar (25) and an inward concavity of the concave region match with the arch shape of the cover board (6).

8. The fastener-free box with fast assembly of claim 7, further comprising:

a water baffle rib (26) inside a region defined by the first baffle bar (24) and the second baffle bar (25);

a water guide groove (27) formed at a joint of the first baffle bar (24) and the second baffle bar (25);

a fixing pin (28) formed at the bottom of each of the left board (4) and the right board (5), the fixing pin (28) protruding therefrom horizontally; and a limiting groove (29) formed on the internal bottom surface of the cover board (6), wherein the fixing pin (28) is restrained in the limiting groove (29) when the left board (4) and the right board (5) are stacked with the top surface facing down onto the internal bottom surface of the cover board (6).

9. The fastener-free box with fast assembly of claim 1, wherein the baseboard (1), the front board (2), the rear board (3), the left board (4), the right board (5), and the cover board (6) are blow molding boards; and, the front board (2), the rear board (3), the left board (4), the right board (5), and the cover board (6) all have plaited structures formed on their external surfaces.

10. The fastener-free box of claim 9, wherein the connection structure further comprises:

an integrated rotatable hinge structure including a hinge shaft (21) that is rotatably attached to a hinge arm (22) correspondingly; and a mating structure configured to enable the hinge arm (22) to attach or detach from the hinge shaft (21) in a certain direction.

11. A fastener-free box, comprising:

a baseboard (1);

a front board (2);

a rear board (3);

a left board (4), a right board (5);

a cover board (6);

a first insert-connection structure between the left board (4) and the baseboard (1) configured to enable the left board (4) to only slide frontward and backward relative to the baseboard (1);

a second insert-connection structure individually formed between the front board (2) and the left board (4) and between the rear board (3) and the left board (4) configured to prevent the left board (4) to slide frontward and backward;

a third insert-connection structure between the rear board (3) and the baseboard (1) configured to prevent the rear board (3) to slide relative to the baseboard (1);

wherein an insert-connection structure configured to form an insert connection with a respective adjacent board is integrally formed on each of the baseboard (1), the front board (2), the rear board (3), the left board (4), and the right board (5);

wherein a connection structure configured to couple with each other is integrally and individually formed on each of the cover board (6) and the rear board (3); and wherein the second insert-connection structure further comprises:

a horizontal retaining groove (7) with an inward opening at a bottom of each of the left board (4) and the right board (5), the horizontal retaining groove (7) being one of a dovetail groove and a T-shape groove; and a horizontal rib (8) configured to form the first insert-connection structure with the horizontal retaining groove (7) at each of the left and right sides of the baseboard (1).

12. The fastener-free box of claim 11, wherein the second insert-connection structure further comprises:

a vertical retaining groove (9) integrally formed on each of the left board (4) and the right board (5), the vertical retaining groove (9) being one of a dovetail groove and a T-shape groove;

a vertical rib (10) integrally formed on each of the front board (2) and the rear board (3), an insert slot (13) integrally formed on the baseboard (1); and a pin (14) integrally formed on the front board (2) and the rear board (3).

13. A fastener-free box, comprising:

a baseboard (1);

a front board (2);

a rear board (3);

a left board (4), a right board (5);

a cover board (6);

a first insert-connection structure between the left board (4) and the baseboard (1) configured to enable the left board (4) to only slide frontward and backward relative to the baseboard (1);

a second insert-connection structure individually formed between the front board (2) and the left board (4) and between the rear board (3) and the left board (4) configured to prevent the left board (4) to slide frontward and backward; and a third insert-connection structure between the rear board (3) and the baseboard (1) configured to prevent the rear board (3) to slide relative to the baseboard (1);

wherein any three perpendicular boards of the baseboard (1), the front board (2), the rear board (3), the left board (4), and the right board (5) are configured to form an interlocking connection structure such that any of the three perpendicular boards cannot have relative movement; and wherein the second insert-connection structure further comprises:

a horizontal retaining groove (7) with an inward opening at a bottom of each of the left board (4) and the right board (5), the horizontal retaining groove (7) being one of a dovetail groove and a T-shape groove; and a horizontal rib (8) configured to form the first insert-connection structure with the horizontal retaining groove (7) at each of the left and right sides of the baseboard (1).

14. The fastener-free box of claim 13, wherein an insert-connection structure configured to form an insert connection with a respective adjacent board is integrally formed on each of the baseboard (1), the front board (2), the rear board (3), the left board (4), and the right board (5).

15. The fastener-free box of claim 13, wherein a connection structure configured to couple with each other is integrally and individually formed on each of the cover board (6) and the rear board (3).

16. The fastener-free box of claim 15, wherein the connection structure further comprises:

an integrated rotatable hinge structure including a hinge shaft (21) that is rotatably attached to a hinge arm (22) correspondingly; and a mating structure configured to enable the hinge arm (22) to attach or detach from the hinge shaft (21) in a certain direction.

* * * * *